US006838136B2

(12) United States Patent
Hann et al.

(10) Patent No.: US 6,838,136 B2
(45) Date of Patent: Jan. 4, 2005

(54) COATED SUBSTRATE FOR USE IN INK-JET PRINTERS

(75) Inventors: Richard Anthony Hann, Ipswich (GB); Barry Pack, Ipswich (GB); Alan Butters, Ipswich (GB); Jeffrey Michael Howell, Ipswich (GB)

(73) Assignee: Imperial Chemical Industries PLC, London (GB)

( * ) Notice: Subject to any disclaimer, the term of this patent is extended or adjusted under 35 U.S.C. 154(b) by 0 days.

(21) Appl. No.: 10/296,095

(22) PCT Filed: May 31, 2001

(86) PCT No.: PCT/GB01/02427

§ 371 (c)(1),
(2), (4) Date: Nov. 25, 2002

(87) PCT Pub. No.: WO01/92023

PCT Pub. Date: Dec. 6, 2001

(65) Prior Publication Data

US 2003/0142186 A1 Jul. 31, 2003

(30) Foreign Application Priority Data

Jun. 1, 2000 (GB) ..... 0013266

(51) Int. Cl.[7] ..... B41M 5/00

(52) U.S. Cl. ..... 428/32.34; 428/32.36

(58) Field of Search ..... 428/32.34, 32.36

(56) References Cited

U.S. PATENT DOCUMENTS 5,219,641 A * 6/1993 Mehta et al.
6,210,808 B1 * 4/2001 Naisby

FOREIGN PATENT DOCUMENTS

| | | |
|---|---|---|
| EP | 0 919 395 A2 | 6/1999 |
| EP | 1 101 624 A2 | 5/2001 |
| WO | 99/21723 | 5/1999 |

* cited by examiner

*Primary Examiner*—Jennifer McNeil
(74) *Attorney, Agent, or Firm*—Morgan, Lewis & Bockius LLP

(57) ABSTRACT

The present invention relates to a coating material for producing a porous ink-absorbent coating on a substrate to be used in ink-jet printers, comprising radiation curable material and particulate material in a liquid carrier, wherein the weight ratio of particulate material to radiation curable material is greater than 1:1. Also disclosed is a process for preparing a coated substrate using such a coating material. Advantageously, the coating material of the present invention does not crack upon curing, and conveniently forms a porous coating having a glossy surface, while retaining a porous structure for ink-absorption.

3 Claims, No Drawings

COATED SUBSTRATE FOR USE IN INK-JET PRINTERS

FIELD OF THE INVENTION

This invention relates to a coated substrate for use in ink-jet printers, to a coating material for application to a substrate to be used in ink-jet printers and to a method of producing the coated substrate using such coating material.

BACKGROUND TO THE INVENTION

Modern ink-jet printers, for example, the Epson Photo EX, are capable of generating images of so called photographic quality. In order to realise the full potential of these printers, it is necessary to use special media on which to print. Some of the essentially required properties for such media are best understood by considering the failure modes of plain paper, typical coated papers and coated films.

1. Plain Paper

When plain paper is used as the receiver medium in an ink-jet printer, it is found that coloured inks penetrate into the paper such that the colour is partially obscured by light scattered by the paper fibres. Additionally, ink is spread laterally by capillary action along the fibres, leading to distortion of the coloured spots that form the image, and thereby to distortion of the image itself. In addition to these faults, the paper is found to distort, sometimes referred to as cockle, by the action of the water present in the ink in the regions of the image that carry a heavy ink loading, or by accidental immersion in water. Finally, plain paper is not glossy because of the rough nature of the fibre surface.

2. Coated Papers

Many of the above defects can be overcome by applying special coatings to the surface of the paper. However, in these products there remains the problem of cockle as referred to above. This is always true for coatings that are permeable to water.

3. Coated Films

The term "coated films" is used to refer to both plastics substrates and papers that are laminated or coated with plastics materials, such that they are not permeable to inks or water, thus preventing cockle. The coatings on these films may be either porous or non-porous. Non-porous coatings may absorb the ink to a greater or lesser extent by a polymer swelling mechanism. Those coatings that swell to a lesser extent are not capable of absorbing all the ink in heavily inked areas and therefore exhibit slow ink drying times after printing, because the print will only fully dry when excess water has evaporated. Those coatings which swell to a greater extent tend to be water soluble, or are easily damaged mechanically, and this limits image stability. WO 99/21724 concerns an ink-jet printing medium comprising a non-porous coating which absorbs water from the applied ink by polymer swelling. Porous coatings have the potential for overcoming these problems by fast absorption of the ink by a controlled uniform capillary process. However, it has been found that there are practical difficulties in achieving a glossy, non-cracked porous coating. Polymeric binders are necessary to achieve acceptable strength in the coating and also to assist in fixing the colorants in the ink. However, it is generally found that the incorporation of polymeric binders in such structures either leads to a non-glossy finish on the one hand or to a slowly absorbing coating on the other.

PRIOR ART

Solutions have been proposed to enable the achievement of a glossy, fast ink absorbing porous structure in two ways, both with inherent processing disadvantages:

(1). It is unknown in the art to gel an aqueous polymer solution based on a silica dispersion by a gradual chilling process, such that a glossy, porous surface is achieved, as described in European Patent specification No. 0813978A1 and European Patent specification No. 0888904A1. However, this process is slow and requires the use of specialist photographic coating machines. It is believed that in this known process, solidification is driven by cooling, and not by loss of water. Indeed, it is difficult if not impossible to achieve the necessary surface flatness that is required for a gloss finish by a normal drying process applied to aqueous polymer solutions based on silica dispersions suitable for forming coatings which rapidly absorb ink.

(2). Coating formulations have also been proposed which are capable of forming dried porous coatings which can be differently processed to give a flat glossy surface, as described in European Patent specification No. 0803375B1. This method involves forming the coating on the substrate and then pressing the coating surface against a smooth surface, finally peeling away the substrate to reveal a flattened glossy surface. Alternatively, the coating may be separately applied to a smooth glossy surface, dried in situ, and then a suitable substrate attached. This assembly may then be peeled away from the smooth casting surface. This latter method disadvantageously involves an additional processing step.

SUMMARY OF THE INVENTION

According to one aspect of the invention, there is provided a method of making a coated substrate for use in ink-jet printers, comprising the steps of applying to at least one surface of the substrate a coating material comprising radiation curable material and particulate material in a liquid carrier, wherein the weight ratio of particulate material to radiation curable material is greater than 1:1, and irradiating the coating material while still wet to form a porous, glossy ink-absorbent coating on the substrate.

The invention also extends to the coated substrate produced by the above described method. According to this aspect of the present invention, there is provided a coated substrate for use in ink-jet printers, comprising a coating material for producing a porous ink-absorbent coating on the substrate, which comprises radiation curable material and particulate material in a liquid carrier, wherein the weight ratio of particulate material to radiation curable material is greater than 1:1.

Furthermore, the invention extends to the coating material for use in the above described method. According to this aspect of the invention, there is provided a coating material for producing a porous ink-absorbent coating on a substrate to be used in ink-jet printers, comprising radiation curable material and particulate material in a liquid carrier, wherein the weight ratio of particulate material to radiation curable material is greater than 1:1.

It is not essential, in the above described method, to irradiate the coating material immediately after application of said coating material to the substrate. It may be advantageous, in some instances, to permit a limited drying out of the coating material to take place first. It is believed that the resulting increase in solids concentration in the coating material so applied assists in maintaining a void volume in the finished coating, which can be advantageous provided said volume is not too large. However, it is to be understood that it is essential to irradiate the coating material while the coating material is still wet, a process known as "curing". Surprisingly, the coating material of the present invention does not crack upon curing, and conveniently forms a porous coating having a glossy surface while retaining a porous structure for typically rapid ink-absorption.

The coating material applied to the substrate may be irradiated by ultra violet radiation (commonly referred to as u.v. radiation) or by electron beam or other energetic radiation. Preferably, the coating material is irradiated by u.v. radiation.

A wide range of radiation curable materials, and in particular u.v. curable materials, can be employed in the invention, provided they are dispersible in water and cross-linkable to give a water-resistant coating. It is however desirable not to employ u.v. curable materials in the coating material which are readily swollen by water such as, for example, polyethylene glycol diacrylate. Preferred examples of suitable u.v. curable materials for use herein include a difunctional urethane acrylate such as Ebecryl 2002 (Ebecryl is a Trade Mark) or a urethane diacrylate such as Ebecryl 2001, both of which are available from UCB resins.

The radiation curable material conveniently binds together the particulate material upon exposure of the coating material to radiation, to thereby increase the mechanical strength of the coating.

Typically, when the coating material is irradiated by u.v. radiation, a photoinitiator is usually present, which initiates the cross-linking reaction of the u.v. curable material in known manner.

A variety of particulate materials may be used in the practice of the present invention, including inorganic materials such as porous silicas (e.g. precipitated or silica gels) and non-porous silicas (e.g. fumed silica), inorganic fillers such as alumina and particles derived from organic materials. Preferably, the particulate material is an inorganic material.

In general, the maximum primary particle size of the particulate materials, particularly inorganic materials, does not exceed 300 nm. A typical minimum primary particle size cannot readily be specified, because aggregation of particles, however, small, would be a dominating factor in coating performance. However, preferably, in the case of silica, desirably fumed silica, the primary size of the particles of the particulate material incorporated in the coating material is in the range 20 to 130 nm, and preferably 30 to 100 nm.

Preferably, the weight ratio of particulate material to radiation curable material, particularly u.v. curable material, is greater than 2:1 and less than 20:1, even more preferably less than 10:1 and even more preferably less than 6:1. It is advantageous to employ the particulate material in higher concentration compared with the radiation curable material, to provide a porous structure in the coating. If radiation curable material is present in the coating material, and thus the coating, in large amounts, the radiation curable material typically fills the voids between the particles, resulting in a non-porous coating. The total concentration of radiation curable material and particulate material in the coating material is typically dependent upon the desired weight ratio of radiation curable material to particulate material, which will be dictated by the desired characteristics of the coating and the chosen coating technique. Generally, high weight ratios of particulate material to radiation curable material provide coatings with rapid absorption properties yet poor mechanical strength, whereas lower weight ratios provide robust coatings with slow absorption properties.

The liquid carrier for the particulate material and the radiation curable material is suitably an aqueous carrier including water or a water/solvent mixture. Alternatively, the liquid carrier may be an organic solvent.

The substrate suitably comprises any material capable of forming a self-supporting opaque, or transparent, film or sheet. By a "self-supporting film or sheet" as referred to herein is meant a film or sheet capable of independent existence in the absence of a supporting base. The substrate is typically a polymeric material, but may alternatively comprise paper, cardboard or other similar materials.

Suitable thermoplastics materials for use in the production of a substrate include a cellulose ester, e.g. cellulose acetate, polystyrene, a polymer and copolymer of vinyl chloride, polysulphone, a homopolymer or copolymer of a 1-olefine, such as ethylene, propylene and but-1-ene, a polyamide, a polycarbonate, and, particularly, a synthetic linear polyester which may be obtained by condensing one or more dicarboxylic acids or their lower alkyl (up to 6 carbon atoms) diesters, e.g. terephthalic acid, isophthalic acid, phthalic acid, 2,5- 2,6- or 2,7-naphthalenedicarboxylic acid, succinic acid, sebacic acid, adipic acid, azelaic acid, 4,4'-diphenyldicarboxylic acid, hexahydroterephthalic acid or 1,2-bis-p-carboxyphenoxyethane (optionally with a monocarboxylic acid, such as pivalic acid) with one or more glycols, particularly an aliphatic glycol, e.g. ethylene glycol, 1,3-propanediol, 1,4-butanediol, neopentyl glycol and 1,4-cyclohexanedimethanol. A polyester terephthalate film is particularly preferred, especially such a film which has been biaxially oriented by sequential stretching in two mutually perpendicular directions, typically at a temperature in the range 70 to 125° C., and preferably heat set, typically at a temperature in the range 150 to 200° C., for example as described in GB-A-838708.

The substrate may also comprise a polyarylether or thio analogue thereof, particularly a polyaryletherketone, polyarylethersulphone, polyaryletheretherketone, polyaryletherethersulphone, or a copolymer or thioanalogue thereof. Examples of these polymers are disclosed in EP-A-1879, EP-A-184458 and U.S. Pat. No. 4,008,203, particularly suitable materials being those sold by ICI PLC under the Trade Mark STABAR. Blends of these polymers may also be employed.

Suitable theremost resin substrate materials include addition-polymerisation resins such as acrylics, vinyls, bismaleimides and unsaturated polyesters: formaldehyde condensate resins such as condensates with urea, melamine or phenols; cyanate resins; functionalised polyesters; polyamides or polyimides.

The substrate suitably has a thickness in the range 25 to 300 $\mu$m, particularly in the range 50 to 175 $\mu$m, and especially in the range 75 to 130 $\mu$m.

The coating material for producing a porous ink-absorbent coating is suitably applied to the substrate by a conventional coating technique, for example by deposition from a solution or dispersion of the coating material.

If it is desired to permit a limited drying out of the coating material to take place before irradiation, partial drying of the applied coating material may be effected by subjecting the applied coating material to gentle forced air flow over its surface at an appropriate temperature e.g. about 60 to 80° C. Drying is stopped while the applied coating material still exhibits a free liquid surface, and the surface of the coating material irradiated, preferably with ultraviolet radiation.

The thickness of the cured coating may vary over a wide range, but is conveniently 50 $\mu$m or less, especially in the range from 2 to 30 $\mu$m, and preferably in the range 5 to 20 $\mu$m, for example 10 $\mu$m.

Additional materials, such as cationic polymers that attach to the colorant dye molecules in the ink to be used in the ink-jet printer, or stabilisers to protect against light fading, or any other additives commonly known in the art may also be incorporated in a coating material according to the present invention. Where such additives are used, due consideration should be given to the stability of the dispersion in the coating material, such that a stable coating viscosity is maintained, and such that excessive light scattering is avoided, because if excessive light scattering occurs at the surface, caused by lack of surface flatness, then the gloss finish is impaired. It is also possible to incorporate the additional materials as a separate step by applying them as a solution to the surface of the coating.

The invention is further described, by way of illustration, in the following examples.

EXAMPLES

1) Preparation of Coating Material in Accordance with the Invention (Coating A)

To a beaker were added, 10 g of Ebecryl (Trade Mark) 2002, a difunctional urethane acrylate (available for example from UCB resins), and 1.5 g of Esacure (Trade Mark) DP250 (a photoinitiator) and the mixture warmed to about 40° C. with stirring until the photoinitiator dissolved. Distilled water (60 g), followed by 2 mls of 0.91 g ammonia were added slowly to the mixture with stirring. Then, 40 g of Aerosil OX50 silica was added to the resulting mixture under high shear conditions and ultrasonically dispersed for 1 minute using an MSE Soniprep (Trade Mark) 150 ultrasonic disintegrator operating at 23 KHz. The ultrasonic treatment was repeated twice, stirring between each treatment.

N.B. It will be understood that Esacure DP250 is a complex liquid mixture to serve as a photoinitiator, available for example from Kromachem Limited, whilst Aerosil OX50 is a fumed silica with a surface area of 50 sq. meters/gm, available for example from Degussa. This fumed silica has an average particle size of 40 nm.

2) Preparation of Comparative Coating Material B

For comparison, a second coating formulation was prepared by adding 33.3 g of Aerosil OX50 silica to 66.6 g of water, and adjusting the pH to 10.5 by use of 10% sodium hydroxide, followed by milling the formulation for 5 minutes in a bead mill. To this mixture was added, with stirring, 17.5 mls of a 10% solution of Mowiol (Trade Mark) 18/88 in water. Mowiol 18/88 is a polyvinyl alcohol/vinyl acetate copolymer.

3) Coating and Drying

The coating material from step 1 above was applied by wire wound bar at a wet thickness of 36 microns to a 160 micron thick paper laminate sheet (supplied by Kyodo) and then subjected to a gentle forced air flow at approximately 60 to 80° C. for about 10 seconds. With the applied coating material still exhibiting a free liquid surface, the drying was stopped and the coating material irradiated with u.v. radiation to form Coating A. The irradiation was effected by five passes at 10 meters per minute through a Minicure unit utilising a medium pressure mercury discharge tube rated at 8W per mm of length.

For comparison, a further paper laminate sheet having the properties described above, was coated in the same manner with the coating material from step 1 above. The surface of the coating material was instead allowed to dry completely by the application of gentle forced air flow before being irradiated with u.v. radiation (Comparative Coating C).

Utilising the same coating technique, Comparative Coating Material B (from step 2 above) was also applied to the surface of a similar substrate, to form a 15 micron thick coating. This coating was dried under conventional conditions in a warm air flow, followed by residence of about 1 minute in an oven at 120° C. (Comparative Coating B).

4) Testing

The coated substrates were then measured for their gloss and ink absorption time. The degree of gloss was measured on a DR Lange Reflektometer, and the ink absorption time measured for a black ink droplet from a Hewlett Packard 51626A cartridge. The results are illustrated in the table below:

5) Results

| SAMPLE | % GLOSS (20 degrees) | INK ABSORPTION TIME (seconds) |
|---|---|---|
| Invention (Coating A) | 20 | .04 |
| Comparative Coating C | 10 | .04 |
| Comparative Coating B | 3.5 | .02 |

It can be seen from the table above that prior art Comparative Coating Material B (Comparative Coating B) containing a soluble polymer binder and particulate silica, which is dried under conventional conditions, does not produce a coating with the desirable combination of high gloss and fast ink absorption. Furthermore, a coating material (Comparative Coating C) including a u.v. curable material and particulate silica that is allowed to dry completely before being exposed to u.v. radiation also failed to give this combination of desirable properties.

What is claimed is:

1. A method of making a coated substrate for use in ink-jet printers, comprising the steps of applying to at least one surface of the substrate a coating material comprising ultraviolet radiation curable material and particulate material in a liquid carrier, wherein the weight ratio of particulate material to ultraviolet radiation curable material is greater than 1:1, and irradiating the coating material while still wet with ultraviolet radiation to form a porous, glossy ink-absorbent coating on the substrate.

2. A method according to claim 1, wherein the coating material is irradiated immediately after application of the coating material to the substrate.

3. A method according to claim 1, wherein the coating material is partially dried before radiation.

* * * * *